US006119962A

United States Patent [19]

Youakim et al.

[11] Patent Number: 6,119,962

[45] Date of Patent: Sep. 19, 2000

[54] FUEL INJECTOR HAVING A TRAPPED VOLUME NOZZLE ASSEMBLY WITH A PRESSURE RELIEF VALVE

[75] Inventors: Mike Youakim, Milwaukee, Wis.; George M. Matta, Peoria, Ill.

[73] Assignee: Caterpillar Inc., Peoria, Ill.

[21] Appl. No.: 09/130,916

[22] Filed: Aug. 7, 1998

[51] Int. Cl.[7] ..... B05B 9/00

[52] U.S. Cl. ..... 239/124; 239/88

[58] Field of Search ..... 239/124, 88, 89, 239/90, 91

[56] References Cited

U.S. PATENT DOCUMENTS

| | | | |
|---|---|---|---|
| 4,213,564 | 7/1980 | Hulsing . | |
| 4,979,676 | 12/1990 | Heln | 239/95 |
| 5,035,221 | 7/1991 | Martin . | |
| 5,429,309 | 7/1995 | Stockner . | |
| 5,826,793 | 10/1998 | Askew | 239/124 |

FOREIGN PATENT DOCUMENTS

| | | |
|---|---|---|
| 0818623 | 7/1997 | European Pat. Off. . |
| 0853196 | 1/1998 | European Pat. Off. . |
| 3008209 | 3/1980 | Germany . |
| 2333804 | 8/1999 | United Kingdom . |

*Primary Examiner*—Steven O. Douglas
*Assistant Examiner*—Huyen Le
*Attorney, Agent, or Firm*—Michael McNeil

[57] ABSTRACT

A fuel injector includes an injector body that defines a pressure relief passage with one end opening into a trapped volume, and a fuel pressurization chamber in fluid communication with a nozzle outlet. A needle valve member is positioned in the injector body and moveable between an inject position in which the fuel pressurization chamber is open to the nozzle outlet, and a closed position in which the nozzle outlet is blocked. The needle valve member has a closing hydraulic surface exposed to fluid pressure in the trapped volume. A pressure relief valve is positioned in the pressure relief passage, and has a valve member with an opening surface exposed to fluid pressure in the trapped volume, and a closing surface exposed to fluid pressure in the fuel pressurization chamber.

20 Claims, 2 Drawing Sheets

FUEL INJECTOR HAVING A TRAPPED VOLUME NOZZLE ASSEMBLY WITH A PRESSURE RELIEF VALVE

TECHNICAL FIELD

The present invention relates generally to fuel injectors, and more particularly to nozzle assemblies for fuel injectors that employ trapped volume nozzle technology to hasten the closure rate of the needle valve member.

BACKGROUND ART

In many fuel injectors, a simple spring biased needle check is used to open and close the nozzle outlet. The needle valve member typically includes at least one lifting hydraulic surface that is acted upon by fuel pressure. A compression spring is positioned to bias the needle toward its closed position. When fuel pressure rises above a valve opening pressure sufficient to overcome the spring, the needle valve member lifts to open the nozzle outlet to commence an injection event. Each injection event ends when fuel pressure drops below a pressure necessary to keep the needle valve open against the action of the biasing spring. When this occurs, the spring pushes the needle valve member downward to its closed position to end the injection event.

An improvement on the simple spring biased needle check is described in U.S. Pat. No. 5,429,309 to Stockner, which improvement is more commonly known as a trapped volume nozzle. In a typical fuel injector employing a trapped volume nozzle, the compression biasing spring and one end of the needle valve member are positioned in a closed volume space. During an injection event, high pressure fuel migrates up the outer guide surface of the needle valve member into the trapped volume. In addition, displacement of the needle into the trapped volume compresses fuel in the trapped volume. These two phenomena raise pressure in the trapped volume to relatively high pressures, which sometimes are in excess of 20 MPa. The purpose of the trapped volume is to increase the speed at which the needle valve member moves to its closed position at the end of an injection event. Those skilled in the art are well aware that in most instances it is desirable to make an injection event end as abruptly as possible in order to decrease undesirable noise and improve emissions from the engine. The trapped volume nozzle achieves this goal by having the needle valve member pushed toward its closed position at the end of an injection event not only by the force of the biasing spring but also by a hydraulic force due to the fluid pressure in the trapped volume that acts on one end of the needle valve member.

Although the concept of a trapped volume nozzle has proved sound in hastening the closure rate of the needle valve member, some undesirable side effects have been observed. In some instances, the relatively high pressure developed in the trapped volume during an injection event is unable to decay to a relatively low pressure between injection events. This has the effect of raising the valve opening pressure for a subsequent injection event since the needle valve member is being held closed by hydraulic pressure in addition to the force of the compression biasing spring. While the ability to have a variable valve opening pressure can in some cases be desirable, predictability problems can develop because of the differing behavior between individual injectors, and malfunctioning can sometimes occur when the injector drops quickly from a rated operating condition to an idle operating condition. In some instances, injector locking can occur in those cases where fuel pressures at idle conditions are significantly lower than that at a rated condition. In some of these instances, the valve opening pressure for the injector can be too high when the injector drops from a rated condition to an idle condition due to the inability of the pressure in the trapped volume to decay between injection events. When this occurs, idle injection pressure is too low to lift the needle valve member to its opened position, no injection occurs, and the engine ceases to operate.

The present invention is directed to overcoming these and other problems associated with fuel injectors employing trapped volume nozzle technology.

DISCLOSURE OF THE INVENTION

A fuel injector includes an injector body that defines a pressure relief passage with one end opening into a trapped volume, and a fuel pressurization chamber in fluid communication with a nozzle outlet. A needle valve member is positioned in the injector body and is movable between an inject position in which the fuel pressurization chamber is open to the nozzle outlet, and a closed position in which the nozzle outlet is blocked to the fuel pressurization chamber. The needle valve member has a closing hydraulic surface exposed to fluid pressure in the trapped volume. A pressure relief valve is positioned in the pressure relief passage, and has a valve member with an opening surface exposed to fluid pressure in the trapped volume, and a closing surface exposed to fluid pressure in the fuel pressurization chamber.

BEST MODE FOR CARRYING OUT THE INVENTION

Figure 1:
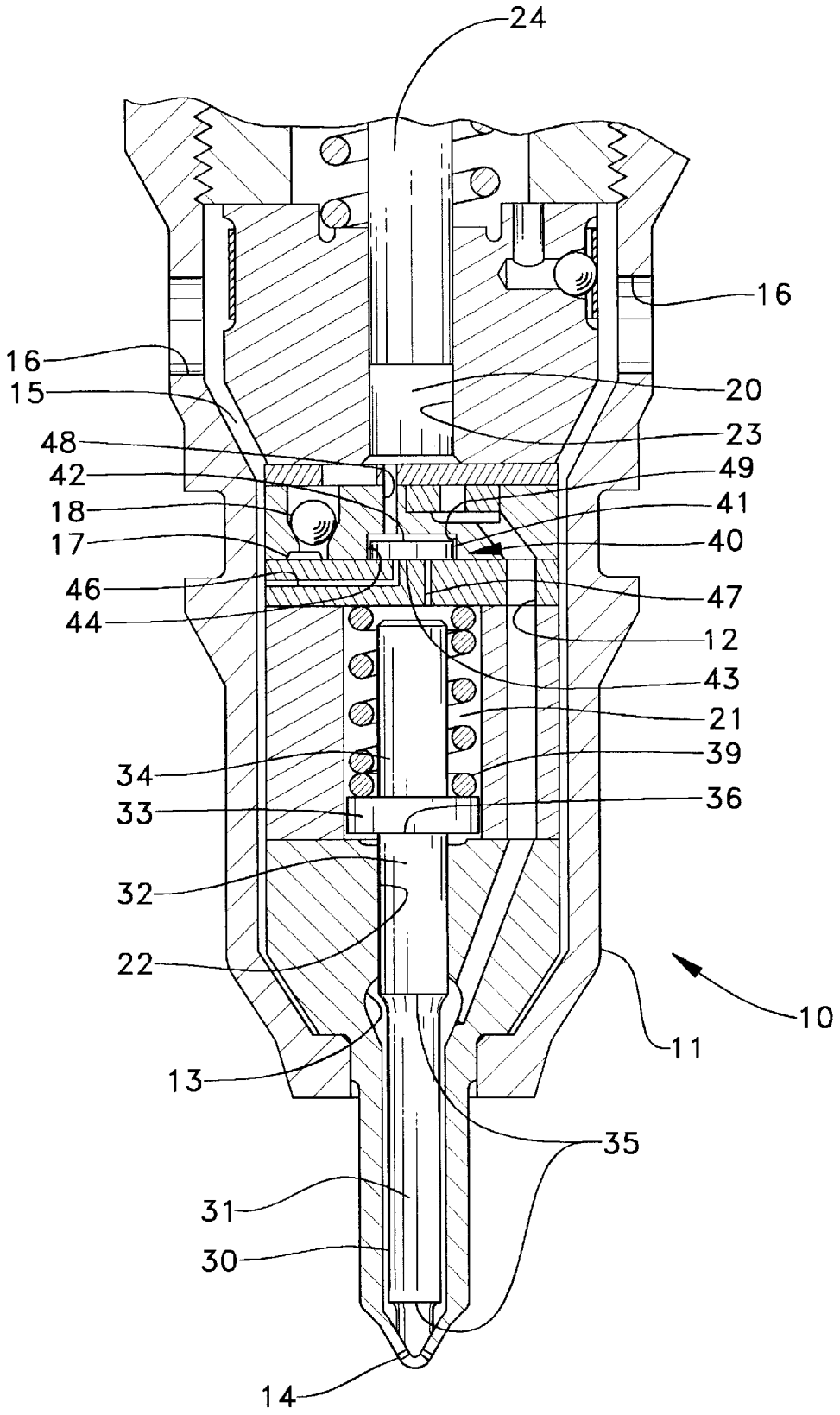
FIG. 1 is a partial front sectioned diagrammatic view of a fuel injector according to one embodiment of the present invention.

Referring now to FIG. 1, a fuel injector 10 includes an injector body 11 made up of a plurality of machined components attached to one another in a manner well known in the art. Injector body 11 defines a fuel pressurization chamber 20 in fluid communication with a nozzle outlet 14 via a nozzle supply passage 12 and nozzle chamber 13. Fuel pressurization chamber 20 is defined by a portion of plunger bore 23 and one end of a plunger 24. Fuel is pressurized when plunger 24 is driven downward by some appropriate means, such as a cam/tappet assembly or a hydraulically driven piston. In either case, those skilled in the art will appreciate that injection pressures are generally made to vary across the operating range of the individual injector. For instance, injection pressures at idle conditions are generally substantially lower than injection pressures at rated conditions.

Between injection events, plunger 24 retracts and draws fresh fuel into fuel pressurization chamber 20. This fuel enters injector body 11 at fuel inlet 16, travels along low pressure fuel supply passage 15, into fuel supply passage 17, past check valve 18, and into fuel pressurization chamber 20. Check valve 18 prevents the reverse flow of fuel when plunger 24 is undergoing its downward pumping stroke during an injection event.

As in a typical fuel injector, a needle valve member 30 is positioned in injector body 11 and is moveable between an inject position in which nozzle outlet 14 is open, and a closed position, as shown, in which nozzle outlet 14 is blocked to nozzle chamber 13. Needle valve member 30 includes a needle portion 31, a guide portion 32, a spacer portion 33 and a pin stop portion 34. Needle valve member 30 is guided in its up and down movement by the relatively small clearance between guide portion 32 and guide bore 22. Needle valve member 30 is normally biased toward its downward closed position by a compression spring 39, which is positioned within a trapped volume 21.

The relatively small clearance area between guide portion 32 and guide bore 22 substantially isolates trapped volume 21 from nozzle chamber 13. Nevertheless, during injection events, when pressure in nozzle chamber 13 is relatively high, some fluid pressure migrates up guide bore 22 to raise pressure within trapped volume 21. In addition, displacement of guide portion 32 into trapped volume 21 compresses fuel therein. Thus, at any given time, the total force tending to push needle valve member 30 toward its downward closed position is the sum of the spring force produced by biasing spring 39 and the hydraulic force produced by fluid pressure in trapped volume 21 acting on closing hydraulic surface 36. In order for the needle valve member 30 to open, this closing force must be overcome by an upward opening force produced by hydraulic fluid pressure acting on lifting hydraulic surfaces 35, which are located in nozzle chamber 13. Thus, in order to move to its open position, the lifting force on needle valve member 30 must be greater than the closing force.

In order to have the ability to vent the built-up fluid pressure in the trapped volume 21 between injection events, the present invention contemplates the inclusion of a pressure relief valve 40. Pressure relief valve 40 is positioned in a pressure relief passage 47 that opens on one end into trapped volume 21. Pressure relief valve 40 includes a plate valve member 41 that has an upper closing surface 42 exposed to fluid pressure in fuel pressurization chamber 20 via a pressure communication passage 48, and an underside opening surface 43 exposed to fluid pressure in trapped volume 2l via pressure relief passage 47. Plate valve member 41 moves with a relatively tight annular clearance 44 in a bore 49 between a closed position, as shown, in which pressure relief passage 47 is blocked, and an upward open position in which pressure relief passage 47 is connected to low pressure fuel supply passage 15 via low pressure passage 46. When plate valve member 41 is in its downward closed position, trapped volume 21 is a closed trapped volume of fluid; however, when plate valve member lifts to its upward open position, pressure in trapped volume 21 quickly equalizes with that of the low pressure fuel supply in inlet 16 and low pressure passage 15.

Figure 2:
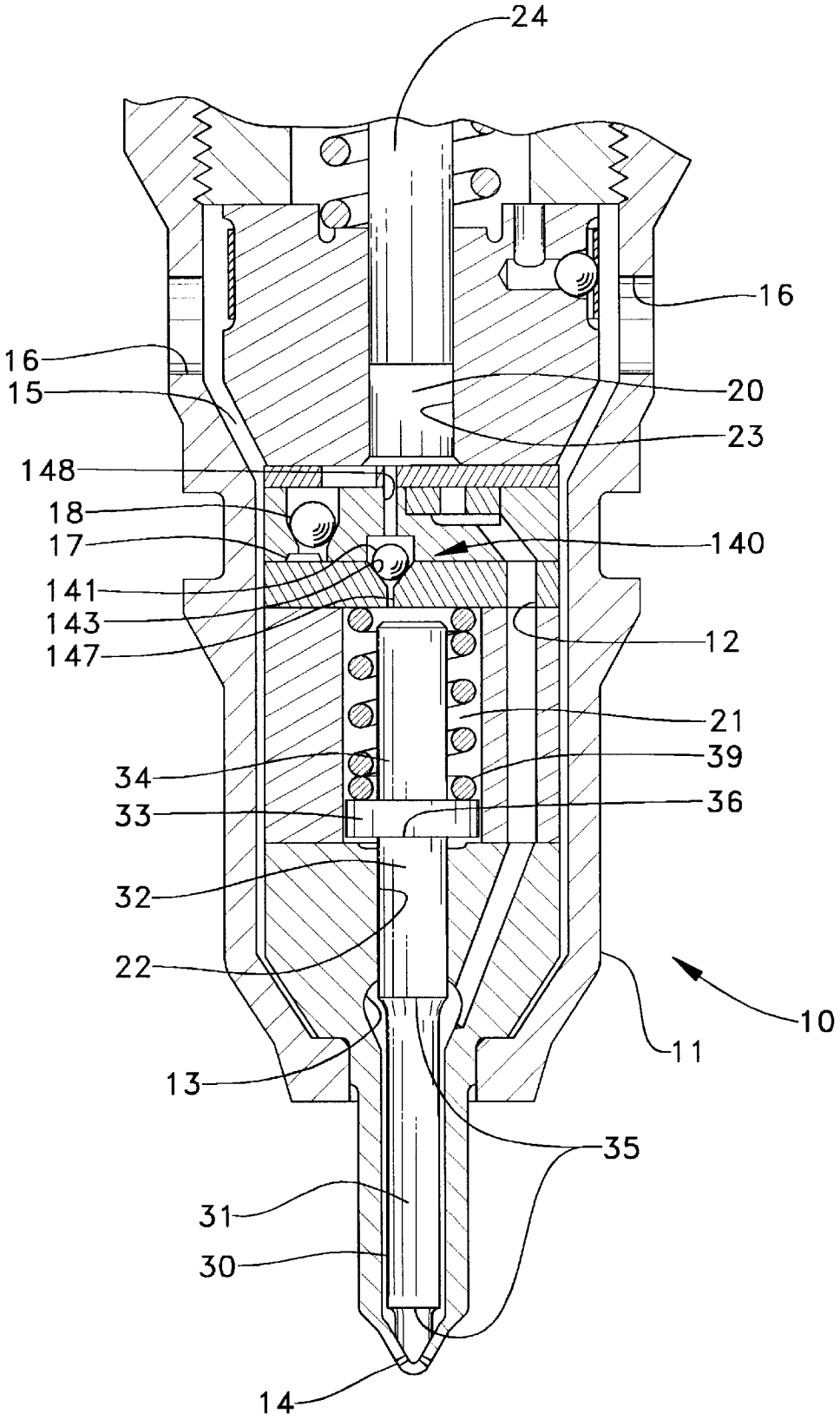
FIG. 2 is a partial front sectioned diagrammatic view of a fuel injector according to another embodiment of the present invention.

Referring now to FIG. 2, a fuel injector 110 is substantially identical to that of the earlier embodiment, except that in this version, pressure in trapped volume 21 is vented directly into fuel pressurization chamber 20 instead of into the outer low pressure fuel supply passage 15 in the previous embodiment. In particular, this embodiment is different in that it includes a pressure relief passage 147 that is separated from a pressure communication passage 148 by a valve seat 143. However, like the earlier embodiment, a pressure relief valve 140, which includes valve seat 143, is positioned in pressure relief passage 147. A ball valve member 141 is moveable between a downward seated position in contact with valve seat 143 that closes pressure relief passage 147 to pressure communication passage 148, and an upward unseated position in which trapped volume 21 communicates directly with fuel pressurization chamber 20 via passages 147 and 148. Pressure relief valve opens when pressure in trapped volume 21 is greater than that in fuel pressurization chamber, and closes when the pressure gradient is the opposite. If the pressure of fuel pressurization chamber 20 is greater than that in trapped volume 21, ball valve member 141 is biased downward to its seated closed position; however, if fluid pressure in trapped volume 21 is greater than that in fuel pressurization chamber 20, ball valve member 141 will lift upward to its open position.

INDUSTRIAL APPLICABILITY

Each injection event is initiated when plunger 24 begins its downward pumping stroke. This causes fuel pressure to build in fuel pressurization chamber 20, which simultaneously closes both check valve 18 and pressure relief valve 40,140. As fuel pressure continues to build, eventually it rises above a valve opening pressure acting on lifting hydraulic surfaces 35 to overcome biasing spring 39 and cause needle valve member 30 to lift upward to its open position. When this occurs, nozzle outlet 14 is open, and fuel commences to spray into the combustion space within the engine. During the injection event, the relatively high fuel pressures existing in nozzle chamber 13 migrate upward along the relatively tight clearance between guide portion 32 and guide bore 22 into trapped volume 21. Pressure in trapped volume 21 will continue to grow until the end of the injection event.

The injection event ends when plunger 24 slows or ceases its downward stroke such that fuel pressure drops below a pressure capable of holding needle valve member 30 in its upward open position. When this occurs, the combined force of biasing spring 39 and the hydraulic pressure force in trapped volume 21 acting on closing hydraulic surface 36 cause needle valve member 30 to move quickly downward to its closed position to provide an abrupt end to the injection event. Shortly thereafter, the pressure relief valve 40,140 opens to relieve pressure within trapped volume 21 in preparation for a subsequent injection event.

The embodiment of FIG. 1 is preferred because the built-up pressure in trapped volume 21 is vented into the low pressure fuel supply passage 15, rather than directly into fuel pressurization chamber 20 as in the embodiment of FIG. 2. In addition, a plate valve member as in FIG. 1 is preferred because the plate should create a better seal and close quicker at the beginning of an injection event. In either case, it is important that pressure relief valve 40,140 remain closed until after needle valve member 30 receives its additional hydraulic push to close the nozzle outlet at the end of an injection event.

The above description is intended for illustrative purposes only, and is not intended to limit the scope of the present invention in any way. For instance, those skilled in the art will appreciate that the pressure relief passage could be repositioned and could possibly be defined at least in part by the needle valve member itself. Thus, the present invention can be modified significantly from the disclosed embodiments without departing from the intended scope of the invention, which is defined in terms of the claims set forth below.

We claim:

1. A fuel injector including:

an injector body defining pressure relief passage with one end opening into a trapped volume, and a fuel pressurization chamber in fluid communication with a nozzle outlet;

a needle valve member positioned in said injector body and being moveable between an inject position in which said fuel pressurization chamber is open to said nozzle outlet, and a closed position in which said nozzle outlet is blocked to said fuel pressurization chamber;

said needle valve member having a closing hydraulic surface exposed to fluid pressure in said trapped volume; and a pressure relief valve positioned in said pressure relief passage, and having a valve member with an opening surface exposed to fluid pressure in said trapped volume, and a closing surface exposed to fluid pressure in said fuel pressurization chamber.

2. The fuel injector of claim 1 wherein said injector body defines a low pressure area; and an opposite end of said pressure relief passage opens to said low pressure area.

3. The fuel injector of claim 2 wherein said valve member is a plate valve member.

4. The fuel injector of claim 3 further including a needle biasing spring operably positioned in said trapped volume to bias said needle valve member toward said closed position.

5. The fuel injector of claim 4 wherein said plate valve member is hydraulically biased toward a position that opens said pressure relief passage when pressure in said trapped volume is greater than pressure in said fuel pressurization chamber.

6. The fuel injector of claim 5 wherein said plate valve member is hydraulically biased toward a position that closes said pressure relief passage when pressure is said trapped volume is less than pressure in said fuel pressurization chamber.

7. The fuel injector of claim 1 wherein an opposite end of said pressure relief passage opens into said fuel pressurization chamber.

8. The fuel injector of claim 7 wherein said valve member is a ball valve member.

9. The fuel injector of claim 8 further including a needle biasing spring operably positioned in said trapped volume to bias said needle valve member toward said closed position.

10. The fuel injector of claim 9 wherein said ball valve member is hydraulically biased toward a position that opens said pressure relief passage when pressure in said trapped volume is greater than pressure in said fuel pressurization chamber.

11. The fuel injector of claim 10 wherein said ball valve member is hydraulically biased toward a position that closes said pressure relief passage when pressure is said trapped volume is less than pressure in said fuel pressurization chamber.

12. A fuel injector including:

an injector body defining pressure relief passage with one end opening into a trapped volume, and a fuel pressurization chamber in fluid communication with a nozzle outlet;

a needle valve member positioned in said injector body and being moveable between an inject position in which said fuel pressurization chamber is open to said nozzle outlet, and a closed position in which said nozzle outlet is blocked to said fuel pressurization chamber;

a needle biasing spring operably positioned in said trapped volume to bias said needle valve member toward said closed position;

said needle valve member having a closing hydraulic surface exposed to fluid pressure in said trapped volume, and an opening hydraulic surface exposed to pressure in said fuel pressurization chamber; and a pressure relief valve positioned in said pressure relief passage, and having a valve member with an opening surface exposed to fluid pressure in said trapped volume, and a closing surface exposed to fluid pressure in said fuel pressurization chamber.

13. The fuel injector of claim 12 wherein said valve member is hydraulically biased toward a position that closes said pressure relief passage when pressure is said trapped volume is less than pressure in said fuel pressurization chamber.

14. The fuel injector of claim 13 wherein said valve member is hydraulically biased toward a position that opens said pressure relief passage when pressure in said trapped volume is greater than pressure in said fuel pressurization chamber.

15. The fuel injector of claim 14 wherein an opposite end of said pressure relief passage opens into said fuel pressurization chamber.

16. The fuel injector of claim 15 wherein said valve member is a ball valve member.

17. The fuel injector of claim 14 wherein said injector body defines a low pressure area; and an opposite end of said pressure relief passage opens to said low pressure area.

18. The fuel injector of claim 17 wherein said valve member is a plate valve member.

19. A fuel injector including:

an injector body defining pressure relief passage with one end opening into a trapped volume, and a fuel pressurization chamber in fluid communication with a nozzle outlet;

a needle valve member positioned in said injector body and being moveable between an inject position in which said fuel pressurization chamber is open to said nozzle outlet, and a closed position in which said nozzle outlet is blocked to said fuel pressurization chamber;

a needle biasing spring operably positioned in said trapped volume to bias said needle valve member toward said closed position;

said needle valve member having a closing hydraulic surface exposed to fluid pressure in said trapped volume, and an opening hydraulic surface exposed to pressure in said fuel pressurization chamber;

a pressure relief valve positioned in said pressure relief passage, and having a valve member with an opening surface exposed to fluid pressure in said trapped volume, and a closing surface exposed to fluid pressure in said fuel pressurization chamber; and said valve member being biased toward a closed position when pressure in said fuel pressurization chamber is above a valve opening pressure sufficient to move said needle valve member to said inject position against said needle biasing spring.

20. The fuel injector of claim 19 wherein said valve member is biased toward a position that opens said pressure relief passage when pressure in said trapped volume is greater than pressure in said fuel pressurization chamber.

* * * * *